US011287840B2

(12) United States Patent
Randlisek

(10) Patent No.: US 11,287,840 B2
(45) Date of Patent: Mar. 29, 2022

(54) VOLTAGE REFERENCE WITH TEMPERATURE COMPENSATION

(71) Applicant: SEMICONDUCTOR COMPONENTS INDUSTRIES, LLC, Phoenix, AZ (US)

(72) Inventor: Zoltan Randlisek, Bratislava (SK)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 11 days.

(21) Appl. No.: 16/949,836

(22) Filed: Nov. 17, 2020

(65) Prior Publication Data

US 2022/0050488 A1 Feb. 17, 2022

Related U.S. Application Data

(60) Provisional application No. 63/065,679, filed on Aug. 14, 2020.

(51) Int. Cl.
*G05F 3/26* (2006.01)

(52) U.S. Cl.
CPC ..... *G05F 3/262* (2013.01); *G05F 3/265* (2013.01)

(58) Field of Classification Search
CPC . G05F 3/262; G05F 3/265; G05F 3/30; G05F 3/26; G05F 3/245; G05F 3/242; G05F 3/225; G05F 3/222; G05F 3/02
See application file for complete search history.

(56) References Cited

U.S. PATENT DOCUMENTS 5,767,664 A 6/1998 Price
6,642,699 B1 11/2003 Gregoire, Jr.
2012/0139523 A1* 6/2012 Kondo ..... G05F 3/30 323/313
2012/0256605 A1* 10/2012 Lecce ..... G05F 3/30 323/265

(Continued)

OTHER PUBLICATIONS

Brokaw, A. Paul, "How to Make a Bandgap Voltage Reference in One Easy Lesson," Copyright 2011 A. Paul Brokaw and Integrated Device Technology, 60 pages.

(Continued)

*Primary Examiner* — Nguyen Tran
(74) *Attorney, Agent, or Firm* — Dickinson Wright PLLC; Mark E. Scott

(57) ABSTRACT

Voltage reference with temperature compensation. At least one example embodiment is a method of producing a compensate voltage reference, the method comprising: driving a reference current through a reference current path of a current mirror, and driving a mirror current through a mirror current path of the current mirror; driving the reference current through a first reference transistor having a control input, and driving the mirror current though a second reference transistor having a control input; equalizing the reference current flow through the first reference transistor to the mirror current flow through the second reference transistor by adjusting a control voltage on the control inputs of the first and second reference transistors; producing a reference voltage proportional to the control voltage; and compensating the reference voltage for temperature effects by adjusting a mirror ratio of the current mirror.

20 Claims, 7 Drawing Sheets

(56) References Cited

U.S. PATENT DOCUMENTS

2015/0002131 A1* 1/2015 Takada ..... G05F 3/24
323/313

OTHER PUBLICATIONS

Brokaw, A. Paul, "A Simple Three-Terminal IC Bandgap Reference," IEEE Journal of Solid-State Circuits, vol. SC-9, No. 6, Dec. 1974, pp. 388-393.

* cited by examiner

VOLTAGE REFERENCE WITH TEMPERATURE COMPENSATION

CROSS-REFERENCE TO RELATED APPLICATIONS

This application claims the benefit of U.S. Provisional Application No. 63/065,679 filed Aug. 14, 2020 and titled "Voltage Reference Compensation Circuit and Method." The provisional application is incorporated herein by reference as if reproduced in full below.

BACKGROUND

Electronic circuits created on semiconductor substrates may use a direct current (DC) reference voltages for a host of functions. For example, the DC reference voltage may be used in voltage regulators to control regulated voltage, may be used in voltage-controlled oscillators to control frequency of operation, and may be used in analog-to-digital converters as a reference for the conversion, to name a few.

However, for consistent operation of the circuits the DC reference voltage should be stable in spite of changing operational temperature of the circuit. Related art voltage reference circuits combine a signal whose response is directly proportional to temperature with a signal whose response is inversely proportional to temperature in an attempt to compensate for temperature variation. An example of a signal whose response is directly proportional to temperature is current through a resistor at a constant applied voltage (e.g., resistance goes down with increasing temperature). An example of a signal whose response is inversely proportional to temperature is base-to-emitter voltage of a bipolar junction transistor at constant current through the transistor (e.g., base-to-emitter voltage goes down with increasing temperature). The related art temperature compensation techniques of combining signals with different temperature response characteristics may be referred to as first-order compensation.

The related-art compensation may be sufficient in many circuits. However, in high precision circuits, first-order compensation alone may not be sufficient.

SUMMARY

At least one example embodiment is a method of producing a compensate voltage reference, the method comprising: driving a reference current through a reference current path of a current mirror, and driving a mirror current through a mirror current path of the current mirror; driving the reference current through a first reference transistor having a control input, and driving the mirror current though a second reference transistor having a control input; equalizing the reference current through the first reference transistor to the mirror current through the second reference transistor by adjusting a control voltage on the control inputs of the first and second reference transistors; producing a reference voltage proportional to the control voltage; and compensating the reference voltage for temperature effects by adjusting a mirror ratio of the current mirror.

In the example method, adjusting the control voltage may further comprise increasing the control voltage responsive to the reference current being greater than the mirror current, and decreasing the control voltage responsive to the reference current being less than the mirror current.

In the example method, compensating the reference voltage may further comprise extracting a compensation current from the reference current path of the current mirror. Extracting the compensation current from the reference current path may further comprise extracting the compensation current having a magnitude, the magnitude proportional to temperature. Extracting the compensation current ma further comprise, for temperatures below room temperature, extracting the compensation current with a magnitude proportional to an amount a signal indicative of temperature is below a predetermined threshold. Extracting the compensation current may further comprise, for temperatures above room temperature, extracting the compensation current with a magnitude proportional to an amount a signal indicative of temperature is above a predetermined threshold.

In the example method, compensating the reference voltage may further comprise extracting a compensation current from the mirror current path of the current mirror. Extracting the compensation current from the mirror current path may further comprise extracting the compensation current having a magnitude, the magnitude proportional to temperature. Extracting the compensation current may further comprise, for temperatures below room temperature, extracting the compensation current with a magnitude proportional to an amount a signal indicative of temperature is below a predetermined threshold. Extracting the compensation current may further comprise, for temperatures above room temperature, extracting the compensation current with a magnitude proportional to an amount a signal indicative of temperature is above a predetermined threshold.

Another example embodiment is a compensated reference voltage circuit, comprising: a main current mirror defining a reference current path and a mirror current path, the main current mirror having current mirror ratio; a first reference transistor having a first current input coupled to the reference current path, a current output, and a control input; a second reference transistor having a first current input coupled to the mirror current path, a current output, and a control input; an output transistor having a current input coupled to a voltage source, a current output coupled to a voltage divider, and a control input coupled to the mirror current path; the control inputs of the first and second reference transistors coupled to a medial node of the voltage divider; and a compensation controller coupled to the main current mirror and coupled to a signal indicative of temperature, the compensation controller configured to adjust the current mirror ratio as a function of the signal indicative of temperature.

In the example compensated reference voltage circuit, when the compensation controller adjusts the current mirror ratio, the compensation controller may be configured to extract a compensation current from the reference current path.

In the example compensated reference voltage circuit, when the compensation controller adjusts the current mirror ratio, the compensation controller may be configured to extract a compensation current from the mirror current path.

In the example compensated reference voltage circuit, the compensation controller may further comprise an operational transconductance amplifier (OTA) having a first compare input coupled to the signal indicative of temperature, and a second compare input coupled to a medial node of the voltage divider, and wherein the OTA is configured to adjust the current mirror ratio responsive to a difference between a voltage of the signal indicative of temperature and a voltage of the medial node of the voltage divider. The OAT may further comprise: a first differential transistor defining a source, a drain, and a gate defining the first compare input; a second differential transistor defining a source coupled to the source of the first differential transistor, a drain, and a gate defining the second compare input; an OTA current mirror defining a reference transistor coupled to the drain of the first differential transistor, and a mirror transistor coupled to the drain of the second differential transistor; a follower transistor having a gate coupled the drain of the second differential transistor, a source coupled to the current mirror, and a drain coupled to a ground reference; and a means for limiting a gate-to-source voltage of the follower transistor. In some cases: the first compare input is a non-inverting input; the second compare input is an inverting input; and the compensation controller adjusts the current mirror ratio when a voltage on the inverting input is higher than a voltage on the non-inverting input. In other cases, the first compare input is an inverting input; the second compare input is a non-inverting input; the compensation controller adjusts the current mirror ratio when a voltage on the inverting input is higher than a voltage on the non-inverting input.

In the example compensated reference voltage circuit, when the compensation controller adjusts the current mirror ratio, the compensation controller may be further configured to adjust the current mirror ratio proportional to a difference in magnitude between the signal indicative of temperature and a reference signal.

In the example compensated reference voltage circuit, the compensation controller may further comprise: a first comparator having a first compare input coupled to the signal indicative of temperature, and a second compare input coupled to a first medial node of the voltage divider, and wherein the compensation controller is configured to adjust the current mirror ratio responsive to a voltage of the signal indicative of temperature crossing a voltage on the second compare input; a second comparator having a first compare input coupled to the signal indicative of temperature, and a second compare input coupled to a second medial node of the voltage divider, and wherein the compensation controller is configured to adjust the current mirror ratio responsive to a voltage of the signal indicative of temperature crossing a voltage on the second compare input of the second comparator.

The example compensated reference voltage circuit may further comprise: a first resistor having a first lead coupled to the current output of the second reference transistor, and a second lead coupled to a common; a second resistor having a first lead coupled to the current output of the first reference transistor, and a second lead coupled the current output of the second reference transistor; and wherein the signal indicative of temperature is a voltage at the current output of the first reference transistor.

BRIEF DESCRIPTION OF THE DRAWINGS

For a detailed description of example embodiments, reference will now be made to the accompanying drawings in which.

DEFINITIONS

Figure 1:
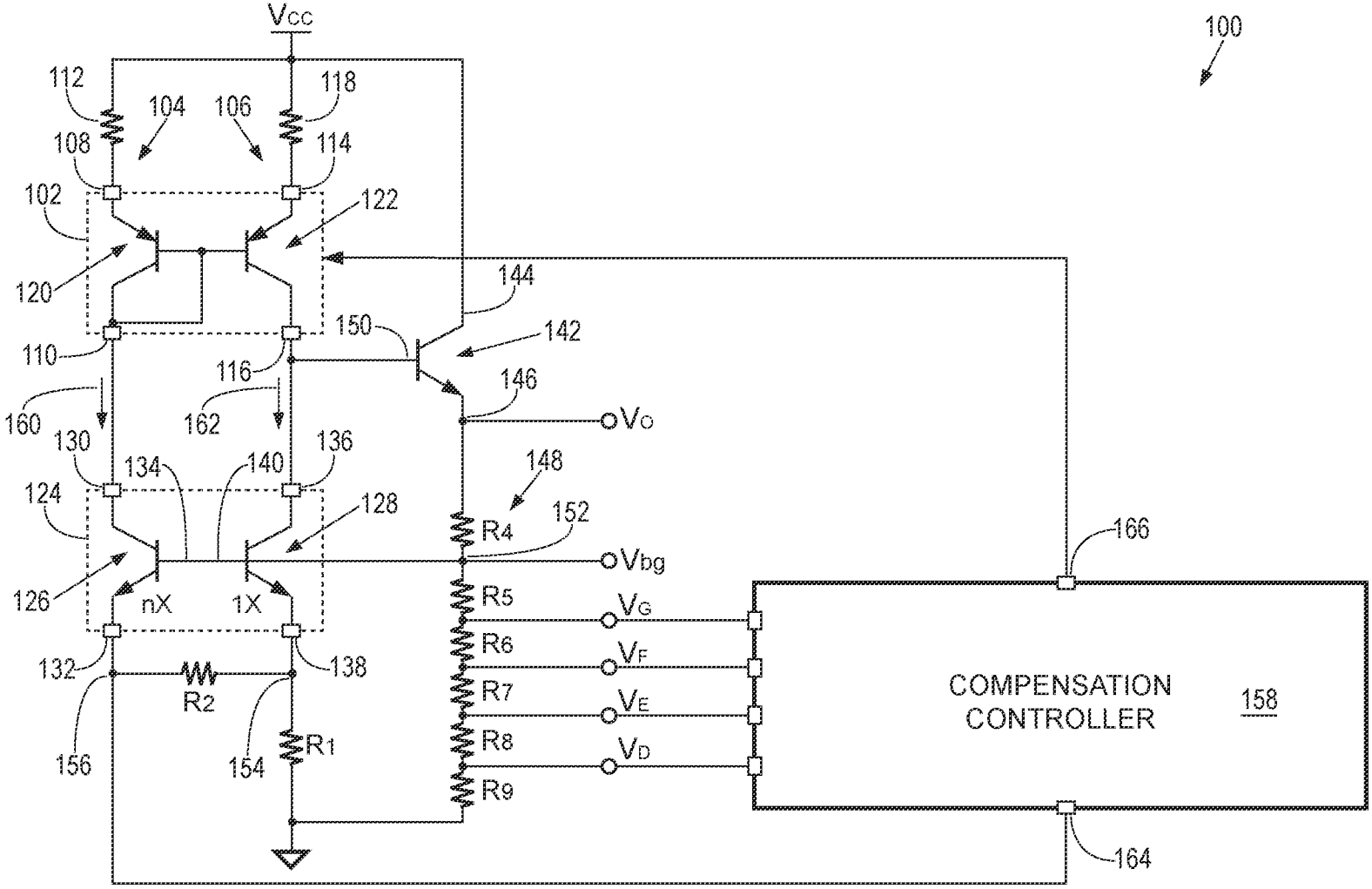
FIG. 1 shows a circuit diagram of a voltage reference circuit in accordance with at least some embodiments.

Various terms are used to refer to particular system components. Different companies may refer to a component by different names—this document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

In relation to electrical devices (whether stand alone or as part of an integrated circuit), the terms "input" and "output" refer to electrical connections to the electrical devices, and shall not be read as verbs requiring action. For example, a compensation controller may have a compensation output that defines an electrical connection to the compensation controller, but shall not be read to require outputting signals. The signal associated with a "compensation output" may be an outward flowing electrical current (e.g. a current driven outward) or inward flowing electrically current (e.g., sinking a current).

"Assert" shall mean changing the state of a Boolean signal. Boolean signals may be asserted high or with a higher voltage, and Boolean signals may be asserted low or with a lower voltage, at the discretion of the circuit designer. Similarly, "de-assert" shall mean changing the state of the Boolean signal to a voltage level opposite the asserted state.

"Controller" shall mean, alone or in combination, individual circuit components, an application specific integrated circuit (ASIC), a microcontroller with controlling software, a digital signal processor (DSP), a processor with controlling software, a programmable logic device (PLD), or a field programmable gate array (FPGA), configured to read inputs and change outputs responsive to the inputs.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Various example embodiments are directed to methods and related systems of generating or producing a reference voltage with additional temperature compensation. More particularly, at least some example embodiments are directed to compensating a reference voltage for temperature effects by adjusting a mirror ratio of a current mirror within the voltage reference circuit that produces the reference voltage. More particularly still, at least some example embodiments perform second-order compensation by extracting current from within a current mirror (e.g., extract from the reference current path, or extract from the mirror current path) in order to change the mirror ratio of the current mirror circuit. The specification now turns to an example circuit to orient the reader.

FIG. 1 shows a circuit diagram of an example reference voltage circuit 100. In particular, FIG. 1 shows the reference voltage circuit 100 comprises current mirror 102. The example current mirror 102 defines a reference current path 104 and a mirror current path 106. The reference current path 104 defines a reference input 108 and a reference output 110. The reference input 108 couples to a voltage source $V_{CC}$ by way of a resistor 112. The mirror current path 106 defines a mirror input 114 and a mirror output 116. Any suitable current mirror may be used, including programmable current mirrors with mirror ratios that are controlled by a controller and/or analog-to-digital converter. The mirror input 114 couples to the voltage source $V_{CC}$ by way of a resistor 118. In some cases, the resistances of resistors 112 and 118 are the same or about the same. In operation, the current mirror 102 senses a current flow along the reference current path 104, and attempts to create a mirror current along the mirror current path 106 based on current flow in the reference current path 104. The current mirror 102 may implement a mirror ratio as between the reference current and the mirror current. In some cases, the mirror ratio as between the reference current and the mirror current may be, or may initially be 1:1, but in other cases the mirror ratio may be adjustable, as discussed more below. Moreover, the initial mirror ratio may be other than 1:1 (e.g., 1:N), in which case the resistors may have the ratio of resistances (e.g., 1:N). The example current mirror 102 comprises a primary transistor 120 having an emitter coupled to the reference input 108 and a collector coupled to the reference output 110. The example current mirror 102 comprises a mirror transistor 122 having an emitter coupled to the mirror input 114 and a collector coupled to the mirror output 116. The bases of the primary transistor 120 and the mirror transistor 122 are coupled together, and are further coupled to the reference output 110. The current mirror 102 is merely illustrative, and other mirror types (e.g., cascade, Wilson, Widlar current mirror may be used).

In operation, a current flow along the reference current path 104 creates a base-to-emitter voltage on the primary transistor 120 that is duplicated on the mirror transistor 122. The duplicated base-to-emitter voltage on the mirror transistor 122 produces a mirror current flow having a magnitude related to the mirror ratio of the current mirror. If the example mirror ratio is 1:1, then the amplitude of the mirror current along the mirror current path 106 should have the same amplitude as the reference current along the reference current path 104.

In the example current mirror 102 of FIG. 1, the transistors are shown as PNP-type bi-polar junction transistors (BJTs). However, current mirrors may be created with many different types of transistors (e.g., BJTs, field effect transistors), and thus current mirror 102 may be implemented in many suitable forms.

The reference voltage circuit 100 further comprises a set of reference transistors 124 in the example form of reference transistor 126 and reference transistor 128. In particular, reference transistor 126 defines a current input 130 coupled to the reference output 110 of the current mirror 102, a current output 132, and a control input 134. The reference transistor 128 defines a current input 136 coupled to the mirror output 116 of the current mirror 102, a current output 138, and a control input 140. The reference transistors 126 and 128 are matched transistors in the sense they are doped the same and have the same current density (e.g., emitter current density) as a function of the current flow into and/or the voltage at the control inputs 134 and 140. However, in the example system the reference transistor 126 has a larger current flow area than the reference transistor 128. If reference transistor 128 is said to have area X, then reference transistor 126 may have an integer multiple larger area (i.e., nX shown in FIG. 1). That is to say, the two reference transistors 126 and 128 may have an area ratio (e.g., emitter area ratio) of 2:1 or more, in some cases 8:1, and in a particular case 256:1.

The example reference transistors 126 and 128 are shown as BJTs, and in particular NPN-type BJTs. Thus, for reference transistor 126 the current input 130 is the collector, the current output 132 is the emitter, and the control input 134 is the base. Similarly, for reference transistor 128 the current input 136 is the collector, the current output 138 is the emitter, and the control input 140 is the base. However, other types of BJTs may be used (e.g., PNP-type BJTs), and in fact other types of transistors (e.g., field effect transistors), and thus the circuit of FIG. 1 should be not read as limiting the scope of the implementation.

Still referring to FIG. 1, the example reference voltage circuit 100 further comprises an output transistor 142 having a current input 144 coupled to the voltage source $V_{CC}$, a current output 146 coupled to ground or common through a voltage divider 148, and a control input 150 coupled to the mirror output 116 and thus the mirror current path 106. The current output 146 of the output transistor 142 defines one example reference voltage output $V_O$ for the reference voltage circuit 100. The output transistor 142 is shown as a BJT, and in particular NPN-type BJT. It follows, for the output transistor 142 the current input 144 is the collector, the current output 146 is the emitter, and the control input 150 is the base. However, other types of BJTs may be used, and in fact other types of transistors (e.g., field effect transistors), and thus the circuit of FIG. 1 should be not read as limiting the scope of the implementation.

For the reference transistors 126 and 128, the control inputs 134 and 140, respectively, are coupled together and further coupled to a medial node of the voltage divider 148. In particular, in the example system the voltage divider 148 comprises a series arrangement of six resistors, labeled R4, R5, R6, R7, R8, and R9. The resistors of the voltage divider couple the voltage output $V_O$ to ground or common, and the electrical connections between each resistor define a node. For example, the electrical connection between resistors R4 and R5 defines a medial node 152, and in the system shown the medial node 152 is coupled to the control inputs 134 and 140. Thus, as the voltage output $V_O$ goes up, the voltage applied to the base-to-emitter junction of each reference transistor 126 and 128 goes up. And oppositely, as the voltage output $V_O$ goes down, the voltage applied to the base-to-emitter junction of each reference transistor 126 and 128 goes down. It is also noted that, because of the mechanism of the additional temperature compensation of the various embodiments, the medial node 152 may also be a reference voltage output (labeled Vbg in the figure) that is lower than the voltage output $V_O$. In fact, any of the nodes of the voltage divider 148 may be the reference voltage passed to downstream devices (not shown).

Still referring to FIG. 1. The current output 138 of the reference transistor 128 is coupled to ground by way of a resistor R1. The current output 132 of reference transistor 126 is coupled to ground by way of a series connection of resistors R2 and R1. Thus, the reference transistors 126 and 128 "see" different downstream resistance. The node defined by the current output 138 of the reference transistor 128 will be referred to herein as the compensation node 154. The node defined by the current output 132 will be referred to herein as the temperature-dependent node 156. The specification now turns to a description of operation of the reference voltage circuit 100, ignoring for now the compensation controller 158 and its operation.

In the absence of the compensation controller 158 the reference voltage circuit 100 may produce a voltage output $V_O$ that has first-order temperature compensation. The operational description is based on an analysis of the boundary conditions, starting with a situation where the current 160 in the reference current path 104, and the current 162 in the mirror current path 106, are very low. In particular, when current 160 and current 162 flow are low, the voltage at the temperature-dependent node 156 and the compensation node 154 are about the same. However, because in the example system the reference transistor 126 has a greater emitter area, more current flows through reference transistor 126 than flows through reference transistor 128. Stated slightly differently, for low current flow where the base-to-emitter voltages of the reference transistors 126 and 128 are about the same, more current flows through the reference transistor 126 because of the great emitter area. Assuming for now that the current mirror 102 has a mirror ratio of 1:1, the current mirror 102 attempts to drive current 162 along the mirror current path 106 equal to current 160 along the reference current path 104. Because the full mirrored current cannot flow through the reference transistor 128, a certain amount of the current is diverted into the control input 150 of the output transistor 142. Stated otherwise, reference transistor 128 cannot sink all the current 162, and thus the voltage at the control input 150 rises. An increased current flow into output transistor 142 increases the base-to-emitter voltage of output transistor 142, and thus increases the magnitude of the voltage output $V_O$.

Now consider the opposite situation, and still ignoring for now the compensation controller 158. In particular, when current flow is very large the voltage at the temperature-dependent node 156 may be large, taking into account the combined resistances of R2 and R1. However, the reference transistor 128 sees only reference resistor R1, and thus more current may flow through reference transistor 128 than flows through reference transistor 126 in spite of the difference in the emitter area ratio. When the reference transistor 128 flows more current than the reference transistor 126, it follows that less current is provided to the control input 150 of the output transistor 142. A decreased current flow into output transistor 142 decreases the base-to-emitter voltage of output transistor 142, and thus decreases the magnitude of the voltage output $V_O$. Stated otherwise, reference transistor 126 provides less current through the current mirror 102, and reference transistor 128 is able to sink more current, and thus the voltage at the control input 150 decreases. Since the output transistor 142 is connected as a follower, the magnitude of the output voltage $V_O$ thus decreases.

Between the two example boundary cases, and in steady-state operation, the output transistor 142 drives a voltage output $V_O$ such that the current 160 of the reference current path 104 matches the current 162 of the mirror current path 106 (ignoring the relatively small current into the control input 150 of the output transistor 142). The example reference voltage circuit 100 thus represents a closed-loop control system that attempts to balance the currents flowing through the reference transistors 126 and 128 by making adjustments to the voltage output $V_O$. In steady-state operation, the difference in base-to-emitter voltage as between the reference transistor 126 and the reference transistor 128 is proportional to absolute temperature of the circuit. The difference in base-to-emitter voltage as between the reference transistor 126 and the reference transistor 128 appears across resistor R2. In particular, in steady-state operation of the reference voltage circuit 100, the voltage across R2 is directly proportional to absolute temperature.

Moreover, the voltage at compensation node 154 is proportional to absolute temperature. That is, resistance of a resistor is inversely proportional to temperature. The example resistor R1 carries the sum of the current 160 and the current 162, and thus in steady-state operation where the current is constant, the voltage at the compensation node is proportional to absolute temperature. The voltage developed at the medial node 152 thus has first-order temperature compensation that takes into account the directly proportional nature of the difference in base-to-emitter voltage of reference transistors 126 and 128 to absolute temperature, and the inversely proportional nature of the base-to-emitter voltage of reference transistors 128. The current mirror 102, the output transistor 142, the set of reference transistors 124, and the resistors R1 and R2 are known as a Brokaw circuit or Brokaw cell.

Figure 2:
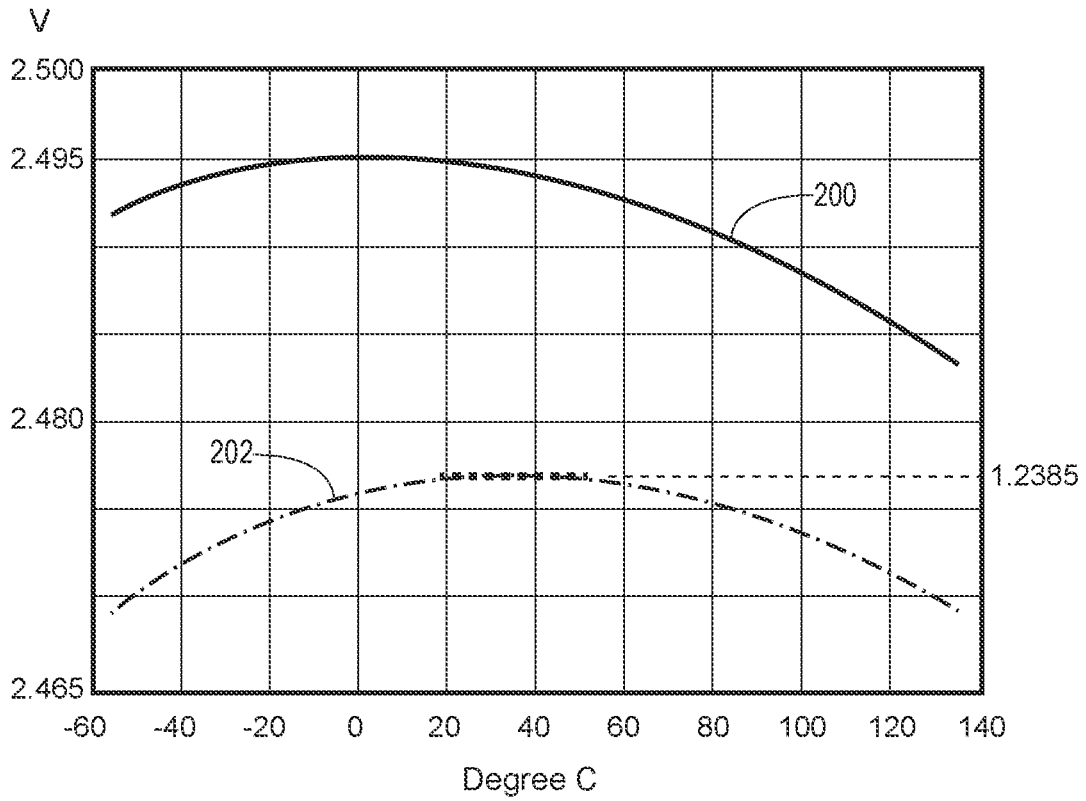
FIG. 2 shows a co-plot of voltage output $V_O$ and voltage at a medial node in accordance with at least some embodiments.

It turns out, however, that the while the difference in base-to-emitter voltage of reference transistors 126 and 128 is directly proportional to temperature, the base-to-emitter voltage is inversely proportional to absolute temperature. Summing these voltages, one proportional to absolute temperature multiplied with 2×R2/R1 and one with inversely proportional to absolute temperature, the resulting voltage output $V_O$ thus has a parabolic shape with a peak at about in the middle of operating temperature range (e.g., −60° C. to 125° C.). FIG. 2 shows a plot of voltage output $V_O$ and voltage at the medial node 152 as a function of temperature in the absence of additional temperature compensation of the example embodiments. In particular, FIG. 2 shows an example co-plot of the voltage output $V_O$ (solid line 200 referenced to left vertical axis) and voltage at the medial node 152 (dash-dot-dash line 202 referenced to the right vertical axis) as a function of temperature. FIG. 2 shows that the voltage at the medial node 152, in spite of the first order temperature compensation, has a parabolic shape with an example peak at a voltage of about 1.2385 Volts at about 30° C. (e.g., the bandgap voltage for a PN junction near room temperature). Stated otherwise, the voltage at the medial node 152, adjusted to ensure matched currents through the reference transistors 126 and 128 and over the ranges of temperatures shown, may take the form of line 202. In example cases, during circuit characterization the resistor R1 may be trimmed (e.g., laser trimmed) to temperature compensate the desired voltage output $V_O$ in the range of expected operating temperatures. However, and as shown in FIG. 2, if the expected operating temperatures span too wide a range, the first-order temperature compensation may be insufficient to provide suitable accuracy over the extended range of temperatures.

Returning to FIG. 1. In accordance with example embodiments, the compensation controller 158 is designed and constructed to provide additional temperature compensation for the reference voltage circuit 100. In particular, the compensation controller 158 defines temperature input 164 coupled to the temperature-dependent node 156 and over which the example compensation controller 158 receives a signal indicative of temperature (e.g., a voltage indicative of temperature). Further, the example compensation controller 158 defines compensation output 166 coupled to the current mirror 102. The example compensation controller 158 is designed and constructed to adjust the mirror ratio of the current mirror 102 as a function of the signal indicative of temperature received on the temperature input 164. The specification now turns to an example embodiment of adjusting the mirror ratio of the current mirror 102.

Figure 3:
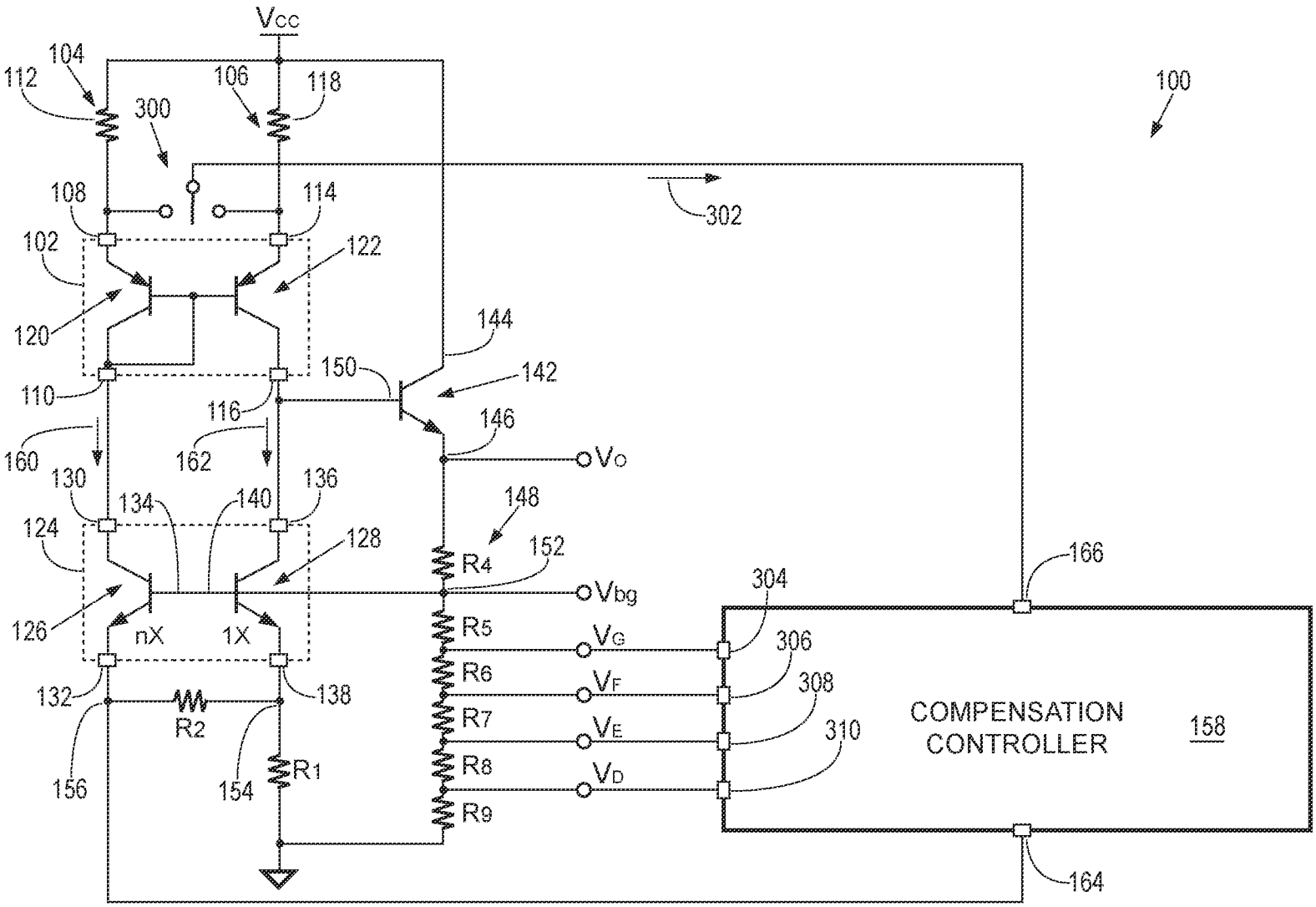
FIG. 3 shows a circuit diagram of a voltage reference circuit in accordance with at least some embodiments.

FIG. 3 shows a circuit diagram of the reference voltage circuit 100, including example schematic of a system for adjusting the mirror ratio. In particular, the example reference voltage circuit 100 comprises a selectable connection 300 illustrated as a single-pole double-throw switch (in mid-throw). The example shared connection couples to the compensation output 166. One pole of the selectable connection 300 is coupled to the reference input 108, and the second pole is coupled to the mirror input 114. In practice, the selectable connection 300 is constructed on the silicon such that the shared connection is electrically coupled to the poles (i.e., electrically coupled to THE reference input 108 or the mirror input 114). During circuit characterization, the connection to one pole or the other is removed (e.g., laser trimmed, Zener diode zapping, metal fuses, one time programmable memory (OTP)) to control whether the extraction of a compensation current results in an increase the magnitude of the voltage output $V_O$ or a decrease to the magnitude of the voltage output $V_O$. That is, because of normal process variations (e.g., slight differences in doping, slight line width differences caused by vagaries of etching), the voltage output $V_O$ may be higher or lower than the designer intended. By removal of portions of the selectable connection 300, the polarity of the correction to achieve the final voltage output $V_O$ may be controlled.

Consider that the compensation controller 158 needs to increase the voltage output $V_O$. In such a situation, during device characterization and trimming the connection from the shared connection to the pole associated with the mirror input 114 may be removed or burned away, leaving only an electrical connection between the compensation output 166 and the reference input 108 of the current mirror 102. In accordance with at least some example embodiments, the compensation controller 158 extracts a compensation current from the reference current path 104, as illustrated by arrow 302 (hereafter just compensation current 302). Extraction of the compensation current 302 from the reference current path 104 results in increasing the voltage output $V_O$. In particular, extracting the compensation current from the reference input 108 results in a change in the base-emitter voltages of transistors 120 and 122 of the current mirror. The total current through resistor 112 becomes the sum of the current 160 (which remains almost unchanged in spite of the extraction) and the compensation current 302. The change in base-emitter voltage of the mirror transistor 122 thus causes an incremental increase in the current along the mirror current path 106. However, the incremental increase in current along the mirror current path 106 cannot be carried by the reference transistor 128, the voltage at the control input 150 increases, and thus the additional current is forced to the control input 150 of the output transistor 142, incrementally raising the voltage output $V_O$. The result of the extraction of the compensation current 302 is a change in the mirror ratio, where the mirror transistor 122 momentarily carries a greater current magnitude than carried along the reference current path 104. In particular, the extraction of the compensation current 302 may result in a mirror ratio of 1:N where N is a positive real number greater than one. While the mirror current path 106 can carry more current (and does initially after extraction), eventually the reference transistors 126 and 128 are adjusted to balance the current.

Now consider the opposite situation in which the compensation controller 158 needs to decrease the voltage output $V_O$. In such a situation, during device characterization and trimming, the connection from the shared connection to the pole associated with the reference input 108 may be removed or burned away, leaving only an electrical connection between the compensation output 166 and the mirror input 114 of the current mirror 102. In the resulting arrangement the compensation controller 158 extracts a compensation current from the mirror current path 106, again shown as compensation current 302. Extraction of the compensation current 302 from the mirror current path 106 results in decreasing the voltage output $V_O$. In particular, extracting the compensation current from the mirror input 114 lowers the base-emitter voltage of mirror transistor 122 by the voltage drop caused by the compensation current 302 flowing through resistor 118, and thus current flow along the mirror current path 106, as the base-emitter voltage of transistors 120 and 122 remains unchanged. The extraction of the compensation current thus results in a decreases of the voltage at control input 150 since reference transistor 128 is able to sink more current, resulting in less current supplied to the control input 150 of the output transistor 142, incrementally lowering the voltage output $V_O$. The reference voltage circuit 100 thus settles at a new voltage output Vo slightly lower than the voltage output $V_O$ prior to the extracting the compensation current 302.

Considered from a voltage standpoint, extracting the compensation current 302 prior to the mirror input 114 lowers the voltage at the mirror input 114 compared to the voltage at the reference input 108. Thus, more current will initially flow through the reference current path 104 because the higher applied voltage at the reference input 108. As discussed above, higher current in the reference current path 104 results in lowering the output voltage $V_O$ to balance the current. The result of the extraction of the compensation current 302 is a change in the mirror ratio, where the reference current path 104 can carry greater current magnitude than the reference current path. In particular, and in the case of an initial mirror ratio of 1:1, the extraction of the compensation current 302 from the mirror current path 106 may result in a mirror ratio of 1:N where N is a positive real number less than one.

Still referring to FIG. 3. In accordance with example embodiments the magnitude of the compensation current 302 extracted, and thus the magnitude of the adjustment to the mirror ratio, may be based on the absolute temperature of the reference voltage circuit 100. To this end, the example compensation controller 158 defines a plurality of reference signals extracted from the voltage divider 148. In particular, the compensation controller 158 defines an example four reference inputs 304, 306, 308, and 310. The reference input 304 is coupled to a medial node of the voltage divider 148, in this case the node defined between resistor R5 and resistor R6. The reference input 306 is coupled to a medial node of the voltage divider 148, in this case to a node defined between resistor R6 and resistor R7. The reference input 308 is coupled to a medial node of the voltage divider 148, in this case to a node defined between resistor R7 and resistor R8. The reference input 310 is coupled to a medial node of the voltage divider 148, in this case to a node defined between resistor R8 and resistor R9. The voltages on the respective reference inputs define a plurality of temperature ranges, and the example compensation controller 158 is designed and constructed to control the magnitude of the compensation current 302 based on the plurality of temperature ranges. More particularly, the compensation controller 158 is designed and constructed to compare a signal indicative of temperature received on the temperature input 164 to a plurality of temperature ranges defined by the reference voltages on the reference inputs 304, 306, 308, and 310. Based on the signal indicative of temperature falling into a particular temperature range, the compensation current 302 controls the magnitude of the compensation current.

Figure 4:
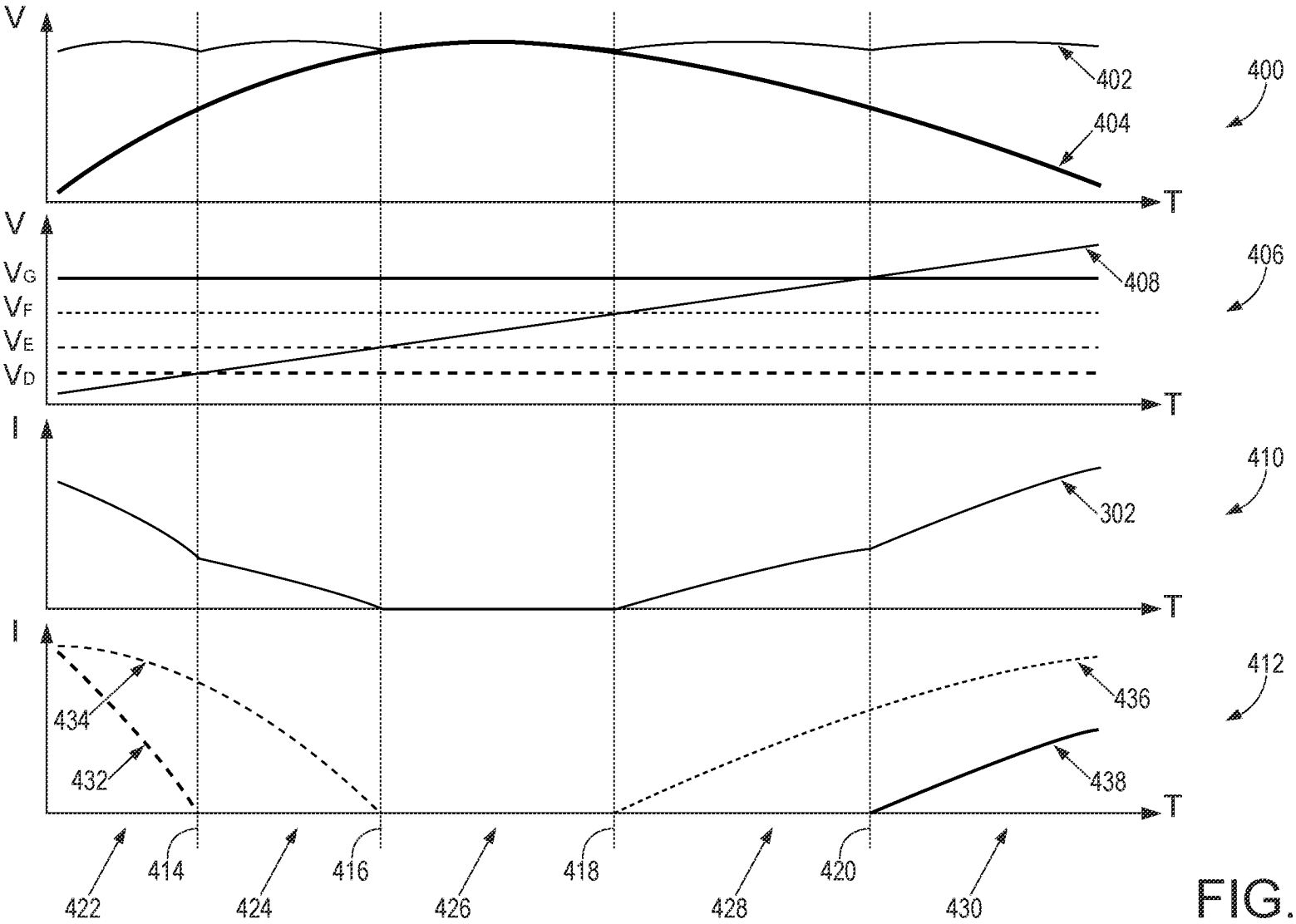
FIG. 4 shows a series of plots of various signals in accordance with at least some embodiments.

FIG. 4 shows a series of plots of various signals in accordance with at least some embodiments. In particular, FIG. 4 shows a series of plots each having its own abscissa axis (not necessarily to scale), and each plot along corresponding ordinate axes being temperature (also not necessarily to scale). Plot 400 is a co-plot of voltage output $V_O$ 402 and partially-compensated voltage output 404 (i.e., having the first-order compensation, but lacking the second-order compensation implemented by compensation controller 158). Plot 406 is a co-plot of each of the reference voltages $V_G$, $V_F$, $V_E$ and $V_D$, along with the signal indicative of temperature 408 (e.g., read from the temperature-dependent node 156). Plot 410 shows an example compensation current 302. And finally, plot 412 shows a plurality of current portions that, in example cases, make up the compensation current 302. The vertical dashed lines 414, 416, 418, and 420 show corresponding temperatures within the various plots.

Referring simultaneously to plot 406 and FIG. 3. In the example system, the reference inputs 304, 306, 308, and 310 receive reference voltages $V_G$, $V_F$, $V_E$ and $V_D$, respectively. Plot 406 shows the example reference voltages, along with the signal indicative of temperature 408. The relationship between the signal indicative of temperature 408 and the reference voltages $V_G$, $V_F$, $V_E$ and $V_D$ define a plurality of temperature ranges or temperature bands. In particular, temperature band 422 is defined between the origin (e.g., the lowest operating temperature) and where the signal indicative of temperature 408 crosses the reference voltage $V_D$ (i.e., vertical line 414). Temperature band 424 is defined between the vertical line 414 and where the signal indicative of temperature 408 crosses the reference voltage $V_E$ (i.e., vertical line 416). Temperature band 426 is defined between the vertical line 416 and where the signal indicative of temperature 408 crosses the reference voltage $V_F$ (i.e., vertical line 418). Temperature band 428 is defined between the vertical line 418 and where the signal indicative of temperature 408 crosses the reference voltage $V_G$ (i.e., vertical line 420). And finally, temperature band 430 is defined between the vertical 420 and the upper end of the temperature range (e.g., the highest operating temperature).

Now referring to plots 406 and 410. In accordance with example embodiments, the magnitude of the compensation current 302 may be different in each temperature band. More particularly still, in example cases, and for at least some temperature bands, the magnitude of the compensation current is proportional to the signal indicative of temperature 408. More particularly again still, in example cases, and for at least some temperature bands, the magnitude of the compensation current is proportional to a difference between the signal indicative of temperature 408, one or more of the reference voltages, and a gain. For example, in temperature band 422 the magnitude of the compensation current 302 may be based on the difference between the signal indicative of temperature 408 and one or both of the reference voltages $V_E$ and $V_D$. In temperature band 424 the magnitude of the compensation current 302 may be based on the difference between the signal indicative of temperature 408 and the reference voltages $V_E$. In the example case shown, no compensation current is extracted in the temperature band 426. In temperature band 428 the magnitude of the compensation current 302 may be based on the difference between the signal indicative of temperature 408 and the reference voltages $V_F$. Finally, in temperature band 430 the magnitude of the compensation current 302 may be based on the difference between the signal indicative of temperature 408 and one or both of the reference voltages $V_G$ and $V_F$.

Referring now to plots 400, 406, and 410. The example compensation current 302 results in different compensation in each of the example temperature bands. Considering first temperature band 426, if the compensation current 302 is zero or near zero in temperature band 426, then only the first order compensation of the Brokaw circuit is implemented in temperature band 426. Thus, the voltage output $V_O$ 402 tracks the partially-compensated voltage output 404 in temperature band 426. Working from the temperature band 426 to the left, in temperature band 424 the compensation current 302 acts to raise the partially-compensated voltage output 404 to create the parabolic shape of the voltage output $V_O$ 402 in temperature band 424. In temperature band 422 the compensation current 302 acts to raise the partially-compensated voltage output 404 to create the parabolic shape of the voltage output $V_O$ 402 in temperature band 422. Similarly for the temperature bands above the temperature band 426, the compensation current 302 acts to raise the partially-compensated voltage output 404 to create the parabolic shapes of the voltage output $V_O$ 402 the respective temperature bands 428 and 430. The compensation applied in the example temperature bands 422, 424, 428, and 430 may also be used to eliminate the effect of the base currents of the reference transistors 126 and 128.

Referring simultaneously to FIGS. 3 and 4. The plots of FIG. 4 assume that the compensation current 302 is extracted from the reference input 108. In other words, the plots of FIG. 4 assume that the compensation output 166 of the compensation controller 158 is coupled in such a way as to extract the compensation current 302 from the reference current path 104, thus raising the output voltage. However, because of mismatches of the reference transistors 126 and 128, it is possible that the partially-compensated voltage output 404 may have an inverted shape, having a minimum voltage rather than a maximum voltage as shown in plot 400. In such cases, the second-order compensation may need to lower the output voltage, and in those cases the compensation output 166 may be coupled to the mirror input 114 (e.g., by laser trimming). Thus, rather than raise the partially-compensated voltage output 404 to create the voltage output $V_O$ 402, the example compensation current 302 would lower the partially-compensated voltage output 404 to create the voltage output $V_O$ 402. Operation would otherwise be the same, and thus the specification does not show a corresponding plot 400 for the lowering case so as not to unduly lengthen the specification.

Making the determination as to the relationship between the signal indicative of temperature on the temperature input 164 and the various voltages on the reference inputs 304, 306, 308, and 310 may take any suitable form. Moreover, creating the compensation current 302 based on the relationships may take any suitable form. The specification now turns to an example compensation controller 158.

Figure 5:
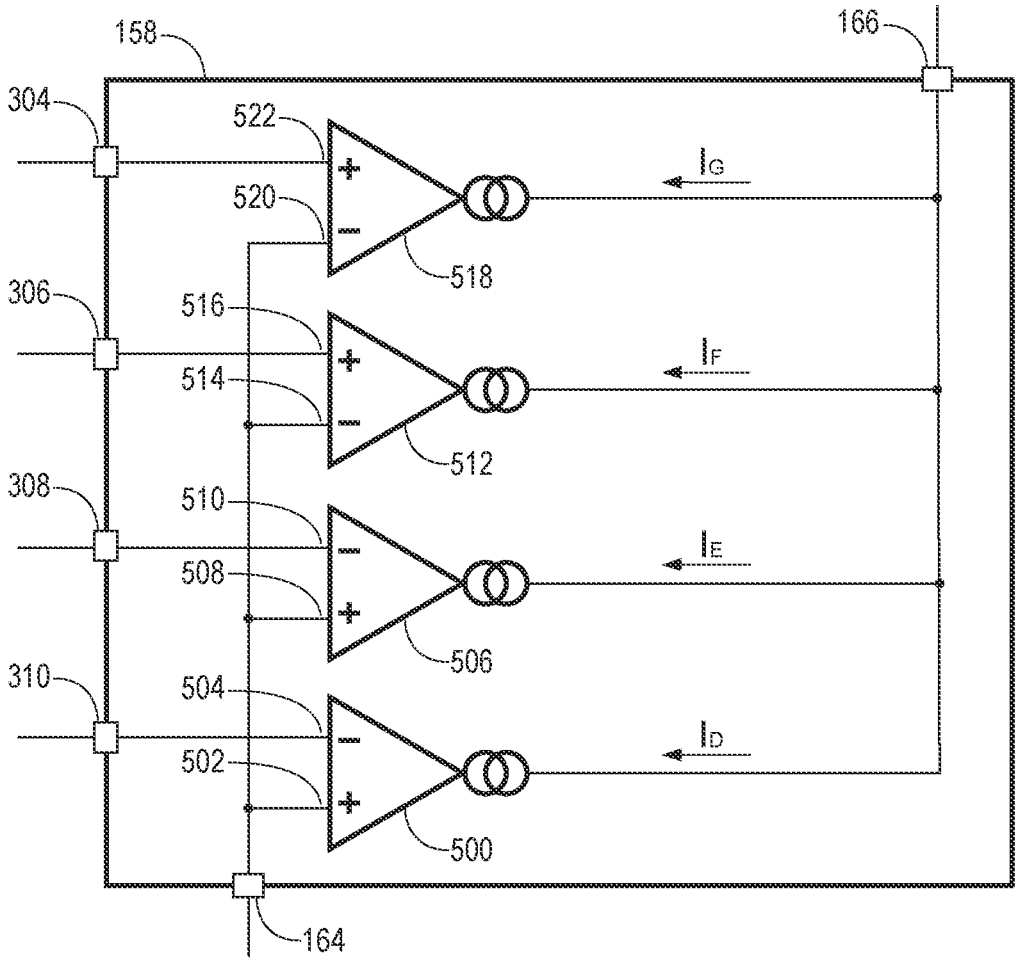
FIG. 5 shows a circuit diagram of an example compensation controller in accordance with at least some embodiments.

FIG. 5 shows a circuit diagram of an example compensation controller 158. In particular, FIG. 5 shows the compensation controller 158 comprises the reference inputs 304, 306, 308, and 310. The compensation controller 158 further defines the temperature input 164 and the compensation output 166. Internally, the example compensation controller 158 includes a plurality of comparators each implemented in the form of operational transconductance amplifiers (hereafter just OTAs). In particular, the example compensation controller 158 includes OTA 500 defining a non-inverting input 502 coupled to the temperature input 164 and an inverting input 504 coupled to the reference input 310. In operation, the OTA 500 compares the signal indicative of temperature sensed on the temperature input 164 to the reference voltage $V_D$ on the reference input 310, and sinks a current flow $I_D$ proportional to a difference in magnitude between the signal indicative of temperature and the reference voltage $V_D$ and a gain. More particularly, when the signal indicative of temperature is applied to the non-inverting input 502 is lower than the reference voltage applied to the inverting input 504, the OTA 500 sinks a current $I_D$ proportional to the difference multiplied by a gain. When the signal indicative of temperature applied to the non-inverting input 502 is higher than the reference voltage applied to the inverting input 504, the OTA 500 sinks no current.

The example compensation controller 158 further includes OTA 506 defining a non-inverting input 508 coupled to the temperature input 164 and an inverting input 510 coupled to the reference input 308. In operation, the OTA 506 compares the signal indicative of temperature sensed on the temperature input 164 to the reference voltage $V_E$ on the reference input 308, and sinks a current flow $I_E$ proportional to a difference in magnitude between the signal indicative of temperature and the reference voltage $V_E$ and a gain. More particularly, when the signal indicative of temperature applied to the non-inverting input 508 is lower than the reference voltage applied to the inverting input 510, the OTA 506 sinks a current $I_E$ proportional to the difference multiplied by a gain. When the signal indicative of temperature applied to the non-inverting input 508 is higher than the reference voltage applied to the inverting input 510, the OTA 506 sinks no current.

The example compensation controller 158 further includes OTA 512 defining an inverting input 514 coupled to the temperature input 164 and a non-inverting input 516 coupled to the reference input 306. In operation, the OTA 512 compares the signal indicative of temperature sensed on the temperature input 164 to the reference voltage $V_F$ on the reference input 306, and sinks a current flow $I_F$ proportional to a difference in magnitude between the signal indicative of temperature and the reference voltage $V_F$ and a gain. More particularly, when the signal indicative of temperature applied to the inverting input 514 is lower than the reference voltage applied to the non-inverting input 516, the OTA 512 sinks no current. When the signal indicative of temperature applied to the inverting input 514 is higher than the reference voltage applied to the non-inverting input 516, the OTA 512 sinks a current $I_F$ proportional to the difference multiplied by the gain.

The example compensation controller 158 further includes OTA 518 defining an inverting input 520 coupled to the temperature input 164 and a non-inverting input 522 coupled to the reference input 304. In operation, the OTA 518 compares the signal indicative of temperature sensed on the temperature input 164 to the reference voltage $V_G$ on the reference input 304, and sinks a current flow $I_G$ proportional to a difference in magnitude between the signal indicative of temperature and the reference voltage $V_G$ and a gain. More particularly, when the signal indicative of temperature applied to the inverting input 520 is lower than the reference voltage applied to the non-inverting input 522, the OTA 518 sinks no current. When the signal indicative of temperature applied to the inverting input 520 is higher than the reference voltage applied to the non-inverting input 522, the OTA 518 sinks a current $I_G$ proportional to the difference multiplied by a gain.

Referring simultaneously to the FIGS. 4 and 5. When the signal indicative of temperature is below the reference voltages $V_E$ and $V_D$, the system operates in temperature band 422. In temperature band 422 both the OTA 500 and OTA 506 are active and sinking current, while OTA 512 and OTA 518 sink no current. In plot 412, the current flow $I_D$ is shown by line 432, and current flow $I_E$ is shown by line 434. Thus, the total compensation current 302 flow in temperature band 422 is the sum of current flow $I_D$ and current flow $I_E$. When the signal indicative of temperature is below the reference voltages $V_E$ but above the reference voltage $V_D$, the system operates in temperature band 424. In temperature band 424 only OTA 506 is active and sinking current. In temperature band 424 OTAs 500, 512, and 518 sink no current. Current flow $I_D$ is shown by line 434. Thus, in the example system the total compensation current 302 in temperature band 424 is the current flow $I_E$ alone.

When the signal indicative of temperature is above the reference voltages $V_E$ and below the reference voltage $V_F$, the example system operates in temperature band 426. In temperature band 426, in the example system the OTAs 500, 506, 512, and 518 sink no current, and thus no second-order compensation is applied in temperature band 426.

When the signal indicative of temperature is above the reference voltages $V_F$ but below the reference voltage $V_G$, the system operates in temperature band 428. In temperature band 428 only OTA 512 is active and sinking current, and OTAs 500, 506, and 518 sink no current. In plot 412, the current flow $I_F$ is shown by line 436. Thus, in the example system the total compensation current 302 in temperature band 428 is the current flow $I_F$ alone. When the signal indicative of temperature is above the reference voltage $V_G$ the system operates in temperature band 430. In temperature band 430 both the OTA 512 and OTA 518 are active and sinking current, while OTA 500 and OTA 506 sink no current. In plot 412, the current flow $I_G$ is shown by line 438. Thus, the total compensation current 302 in temperature band 430 is the sum of current flow $I_F$ and current flow IG.

The example reference voltage system discussed to this point uses four reference voltages, and correspondingly four OTAs, to implement a second-order compensation system across four of the five temperature bands. However, having five temperature bands, and implementing second-order compensation within four of those five temperature bands, is merely illustrative. One having ordinary skill, with the benefit of this disclosure, could implement greater or fewer temperature bands (e.g., three temperature bands, or seven temperature bands). Moreover, the number of temperature bands need not be centered on a temperature band in which second order compensation is omitted. For example, there could be one temperature band below a first-order only temperature band, and two or more temperature bands above the first-order only temperature band. Oppositely, there could be one temperature band above the first-order only temperature band, and two or more temperature zones below the first-order only temperature band. Further still, in some embodiments the second-order compensation may be active in all the temperature bands. The specification now turns to example OTA that may be used in the reference voltage circuit 100.

Figure 6:
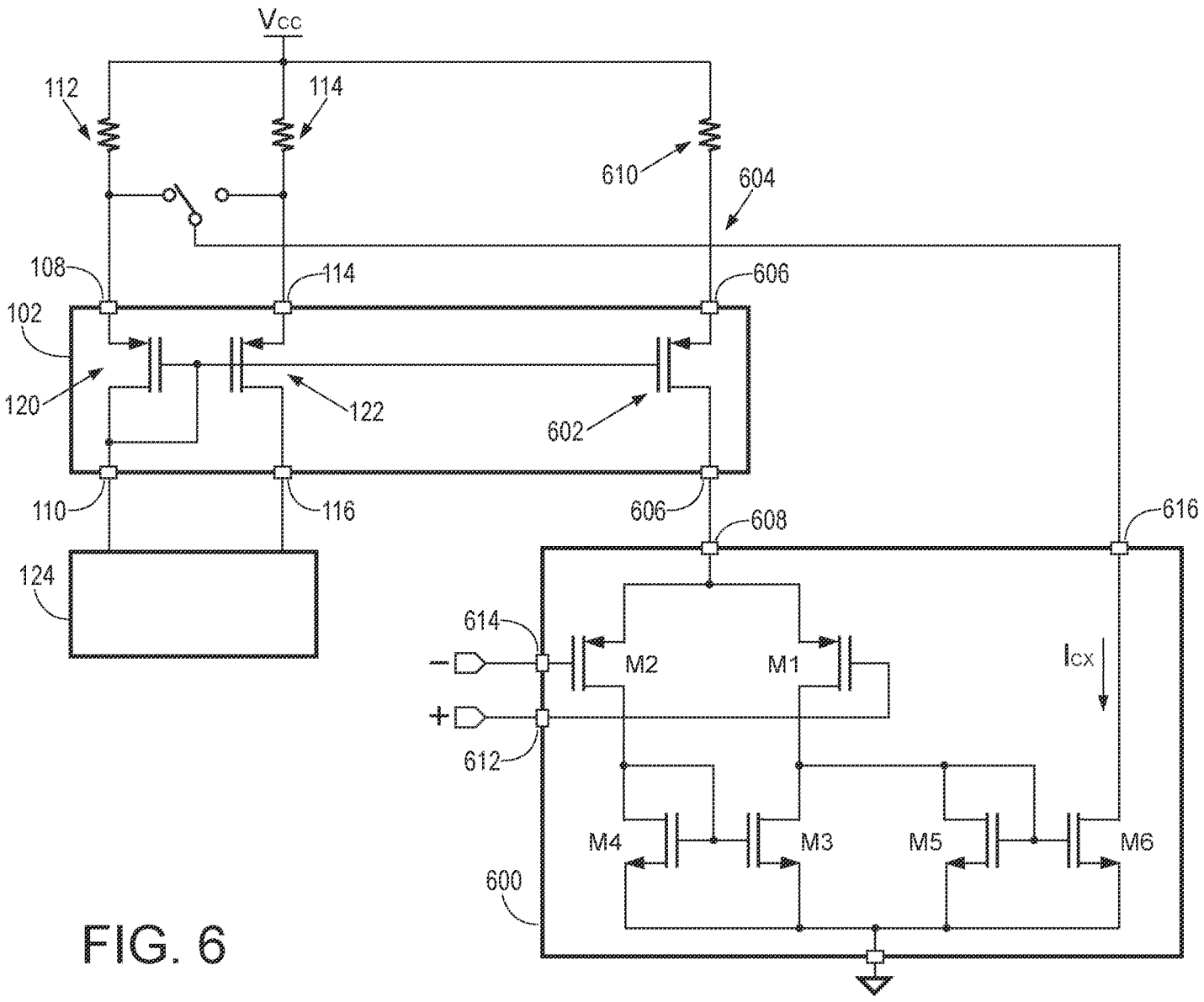
FIG. 6 shows a partial electrical schematic of a reference voltage circuit in accordance with at least some embodiments.

FIG. 6 shows a partial block diagram, partial electrical schematic, of an example reference voltage circuit 100. In particular, FIG. 6 shows an example current mirror 102, a set of reference transistors 124 (e.g., Brokaw circuit), along with a single OTA 600 that is representative of any of the prior OTAs discussed. The additional resistors coupled to the downstream side of the reference transistors 124, as well as the output transistor and voltage divider, would be present but are omitted so as not to further complicate the figure.

The current mirror 102 includes the reference input 108, the reference output 110, the mirror input 114, and the mirror output 116 as previously discussed. The reference input 108 couples to the voltage source $V_{CC}$ by way of resistor 112, and mirror input 114 couples to the voltage source $V_{CC}$ by way of resistor 118. The connection for extraction of the compensation current is shown present and coupled to enable extraction of the compensation current prior to the reference input 108. In the example shown, the primary transistor 120 and mirror transistor 122 are implemented as FETs.

The example current mirror 102 further comprises an additional mirror current path 604 through a mirror transistor 602. In particular, the mirror current path 604 defines a mirror input 606 and a mirror output 608. The mirror input 606 couples to the voltage source $V_{CC}$ by way of a resistor 610. In operation, the current mirror 102 senses a current flow along the reference current path 104, and attempts to create a mirror current along the mirror current path 604 based on current flow in the reference current path 104. The current mirror 102 may implement a mirror ratio as between the reference current and the mirror current along the mirror current path 604. In some cases, the mirror ratio as between the reference current path 104 and the mirror current path 604 may be 1:1, but such is not strictly required. The example mirror transistor 602 of the current mirror a FET having a source coupled to the mirror input 606 and a drain coupled to the mirror output 608. The bases of the reference transistor 120, the mirror transistor 122, and the mirror transistor 602 are coupled together, and are further coupled to the reference output 110.

Turning now to the OTA 600. The example OTA 600 defines a non-inverting input 612, and inverting input 614, and a current output 616. Though not specifically shown, the current output 616 couples to the compensation output 166 of the compensation controller 158. External to the OTA 600, the non-inverting input 612 and the inverting input 614 couple to either a reference voltage or a signal indicative of temperature, depending on whether the OTA 600 is implemented for ranges above or below room temperature, as discussed above.

Internally, the example OTA 600 comprises a differential transistor pair M1 and M2, with the gate of transistor M1 defining the non-inverting input 612 and the gate of transistor M2 defining the inverting input 614. In the example system shown, the transistors M1 and M2 are implemented as P-channel FETs, but other types of FETs, and other types of transistors, may be used. The sources of transistors M1 and M2 are coupled together and coupled to the mirror output 608. Coupling the sources of transistors M1 and M2 to the mirror output 608 limits the total current that can flow through the balance of the example OTA 600 components. Stated otherwise, the sum of the currents through the transistors M1 and M2 cannot exceed the mirror current through the mirror transistor 602.

The drains of the transistors M1 and M2 are coupled to an OTA current mirror implemented by transistors M3 and M4. In the example system shown, the transistors M3 and M4 are implemented as N-channel FETS, but other types of FETs, and other types of transistors, may be used. The drain of transistor M1 is coupled to the drain of the transistor M3, and the source of the transistor M3 is coupled to ground. The drain of the transistor M2 is coupled to the drain of transistor M4, and the source of transistor M4 is coupled to ground. The gates of transistors M3 and M4 are coupled together, and are further coupled to the drain of transistor M4. Thus, in the example OTA 600 the current through the transistor M4 (e.g., a reference transistor), caused by the voltage on the inverting input 614 relative to ground, drives a gate-to-source voltage on the transistor M3 (e.g., a follower transistors).

The voltage developed across the transistor M3 also creates a gate-to-source voltage across a transistor M5, and creates a gate-to-source voltage across transistor M6, both illustratively shown as N-channel FETs (but other types of FETS, and other types of transistors, may be used). As the drain-to-source voltage across transistor M3 increases, the gate-to-source voltage across transistor M6 increases, and vice versa. As the gate-to-source voltage across transistor M6 increases, the portion of the compensation current flow through OTA 600 increases, and vice versa.

Consider, as an example, that the OTA 600 of FIG. 6 is the OTA 500 of FIG. 5. Thus, the non-inverting input 612 is coupled to the temperature input 164, and the inverting input 614 is coupled to the reference input 310 and thus the reference voltage $V_D$. Further consider that the reference voltage circuit 100 is operating in temperature band 422, and in particular operating at the far left side of temperature band 422 (i.e., the lowest operating temperature). In this case, voltage on the non-inverting input 612 is the signal indicative of temperature, the voltage on the inverting input 614 is the reference voltage $V_D$, and thus the non-inverting input 612 has a lower voltage than the inverting input 614. In the example case of the coldest operating of temperature band 422 for OTA 500/600, the transistor M2 is less conductive than the transistor M1, and it follows that transistor M2 carries less current than transistor M1. The current through transistor M2 is a reference current through transistor M4, and the current mirror thus implements a mirror current through transistor M3. In this example situation, transistor M3 can carry only a portion of the current through the through transistor M1, and the remaining current flows transistors M5 connected as a diode, creating a gate-to-source voltage for transistor M6, making transistor M6 conductive. The greater the voltage differential across the non-inverting input 612 and the inverting input 614, the greater the current flow through transistor M1, and the greater the gate-to-source voltage created across transistor M6. In some cases, the entire current flow through the mirror transistor 602 may flow through the transistor M1, and thus transistor M5 acts to set an upper limit for the gate-to-source voltage applied to transistor M6.

Still considering that the OTA 600 of FIG. 6 is the OTA 500 of FIG. 5, and further consider that the reference voltage circuit 100 is operating in temperature band 424 in which the OTA 500/600 is no longer extracting a compensation current. Thus, voltage on the non-inverting input 612 (i.e., the signal indicative of temperature) is higher than the voltage on the inverting input 614 (i.e., the reference voltage $_D$). In the example case of temperature band 424 and OTA 500/600 then, transistor M2 is more conductive than transistor M1, and it follows that transistor M2 carries more current than transistor M1. In fact, in the example situation the transistor M2 may carry the entire current flow through the mirror transistor 602. The current through transistor M2 again is a reference current through transistor M4, and the current mirror thus attempts to implement a mirror current through transistor M3. In this case, however, transistor M4 carries most if not all the mirror current through mirror output 608. It follows that little or no current flows to transistor M5 connected as a diode an no gate-to-source voltage is created to transistor M6 and thus no current flows through transistor M6. Stated otherwise, in this example situation what little current flows through the transistor M1 is sunk through transistor M3, and thus transistor M6 remains non-conductive.

Between these two extremes (e.g., the middle of temperature band 422), the current flow through the mirror transistor 602 is split between flowing through transistors M1 and M2. The greater the voltage developed across the transistor M3, and/or the greater the excess current diverted to the drain of transistor M5, the greater the current flow through transistor M6 and thus the greater the portion of the compensation current through transistor M6.

Figure 7:
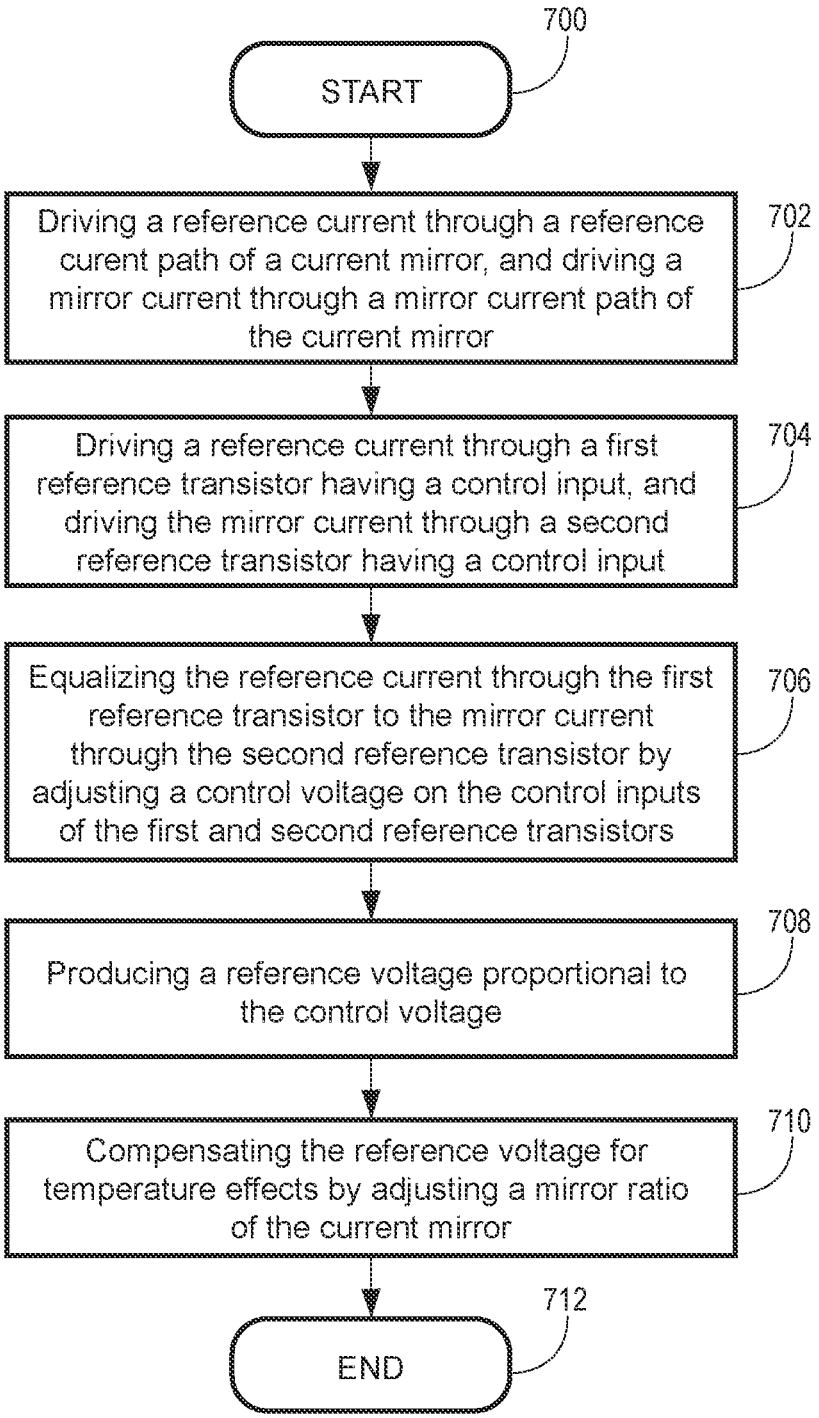
FIG. 7 shows a method in accordance with at least some embodiments.

FIG. 7 shows a method in accordance with at least some embodiments. In particular, the method starts (block 700) and comprises producing a compensate voltage reference by: driving a reference current through a reference current path of a current mirror, and driving a mirror current through a mirror current path of the current mirror (block 702); driving the reference current through a first reference transistor having a control input, and driving the mirror current though a second reference transistor having a control input (block 704); equalizing the reference current through the first reference transistor to the mirror current through the second reference transistors by adjusting a control voltage on the control inputs of the first and second reference transistors (block 706); producing a reference voltage proportional to the control voltage (block 708); and compensating the reference voltage for temperature effects by adjusting a mirror ratio of the current mirror (block 710). Thereafter the method ends (block 712).

Many of the electrical connections in the drawings are shown as direct couplings having no intervening devices, but not expressly stated as such in the description above. Nevertheless, this paragraph shall serve as antecedent basis in the claims for referencing any electrical connection as "directly coupled" for electrical connections shown in the drawing with no intervening device(s).

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A method of producing a compensate voltage reference, the method comprising:

driving a reference current through a reference current path of a current mirror, and driving a mirror current through a mirror current path of the current mirror;

driving the reference current through a first reference transistor having a control input, and driving the mirror current though a second reference transistor having a control input;

equalizing the reference current through the first reference transistor to the mirror current through the second reference transistor by adjusting a control voltage on the control inputs of the first and second reference transistors;

producing a reference voltage proportional to the control voltage; and compensating the reference voltage for temperature effects by adjusting a mirror ratio of the current mirror.

2. The method of claim 1 wherein adjusting the control voltage further comprises increasing the control voltage responsive to the reference current being greater than the mirror current, and decreasing the control voltage responsive to the reference current being less than the mirror current.

3. The method of claim 1 wherein compensating the reference voltage further comprises extracting a compensation current from the reference current path of the current mirror.

4. The method of claim 3 wherein extracting the compensation current from the reference current path further comprises extracting the compensation current having a magnitude, the magnitude proportional to temperature.

5. The method of claim 3 wherein extracting the compensation current further comprises, for temperatures below room temperature, extracting the compensation current with a magnitude proportional to an amount a signal indicative of temperature is below a predetermined threshold.

6. The method of claim 3 wherein extracting the compensation current further comprises, for temperatures above room temperature, extracting the compensation current with a magnitude proportional to an amount a signal indicative of temperature is above a predetermined threshold.

7. The method of claim 1 wherein compensating the reference voltage further comprises extracting a compensation current from the mirror current path of the current mirror.

8. The method of claim 7 wherein extracting the compensation current from the mirror current path further comprises extracting the compensation current having a magnitude, the magnitude proportional to temperature.

9. The method of claim 7 wherein extracting the compensation current further comprises, for temperatures below room temperature, extracting the compensation current with a magnitude proportional to an amount a signal indicative of temperature is below a predetermined threshold.

10. The method of claim 7 wherein extracting the compensation current further comprises, for temperatures above room temperature, extracting the compensation current with a magnitude proportional to an amount a signal indicative of temperature is above a predetermined threshold.

11. A compensated reference voltage circuit, comprising:

a main current mirror defining a reference current path and a mirror current path, the main current mirror having current mirror ratio;

a first reference transistor having a first current input coupled to the reference current path, a current output, and a control input;

a second reference transistor having a first current input coupled to the mirror current path, a current output, and a control input;

an output transistor having a current input coupled to a voltage source, a current output coupled to a voltage divider, and a control input coupled to the mirror current path;

the control inputs of the first and second reference transistors coupled to a medial node of the voltage divider; and a compensation controller coupled to the main current mirror and coupled to a signal indicative of temperature, the compensation controller configured to adjust the current mirror ratio as a function of the signal indicative of temperature.

12. The compensated reference voltage circuit of claim 11, wherein when the compensation controller adjusts the current mirror ratio, the compensation controller is configured to extract a compensation current from the reference current path.

13. The compensated reference voltage circuit of claim 11, wherein when the compensation controller adjusts the current mirror ratio, the compensation controller is configured to extract a compensation current from the mirror current path.

14. The compensated reference voltage circuit of claim 11, wherein the compensation controller further comprises an operational transconductance amplifier (OTA) having a first compare input coupled to the signal indicative of temperature, and a second compare input coupled to a medial node of the voltage divider, and wherein the OTA is configured to adjust the current mirror ratio responsive to a difference between a voltage of the signal indicative of temperature and a voltage of the medial node of the voltage divider.

15. The compensated reference voltage circuit of claim 14, wherein the OTA further comprises:

a first differential transistor defining a source, a drain, and a gate defining the first compare input;

a second differential transistor defining a source coupled to the source of the first differential transistor, a drain, and a gate defining the second compare input;

an OTA current mirror defining a reference transistor coupled to the drain of the first differential transistor, and a mirror transistor coupled to the drain of the second differential transistor;

a follower transistor having a gate coupled the drain of the second differential transistor, a source coupled to the current mirror, and a drain coupled to a ground reference; and a means for limiting a gate-to-source voltage of the follower transistor.

16. The compensated reference voltage circuit of claim 15 further comprising:

the first compare input is a non-inverting input;

the second compare input is an inverting input;

wherein the compensation controller adjusts the current mirror ratio when a voltage on the inverting input is higher than a voltage on the non-inverting input.

17. The compensated reference voltage circuit of claim 15 further comprising:

the first compare input is an inverting input;

the second compare input is a non-inverting input;

wherein the compensation controller adjusts the current mirror ratio when a voltage on the inverting input is higher than a voltage on the non-inverting input.

18. The compensated reference voltage circuit of claim 11, wherein when the compensation controller adjusts the current mirror ratio, the compensation controller is further configured to adjust the current mirror ratio proportional to a difference in magnitude between the signal indicative of temperature and a reference signal.

19. The compensated reference voltage circuit of claim 11, wherein the compensation controller further comprises:

a first comparator having a first compare input coupled to the signal indicative of temperature, and a second compare input coupled to a first medial node of the voltage divider, and wherein the compensation controller is configured to adjust the current mirror ratio responsive to a voltage of the signal indicative of temperature crossing a voltage on the second compare input;

a second comparator having a first compare input coupled to the signal indicative of temperature, and a second compare input coupled to a second medial node of the voltage divider, and wherein the compensation controller is configured to adjust the current mirror ratio responsive to a voltage of the signal indicative of temperature crossing a voltage on the second compare input of the second comparator.

20. The compensated reference voltage circuit of claim 11 further comprising;

a first resistor having a first lead coupled to the current output of the second reference transistor, and a second lead coupled to a common;

a second resistor having a first lead coupled to the current output of the first reference transistor, and a second lead coupled the current output of the second reference transistor; and wherein the signal indicative of temperature is a voltage at the current output of the first reference transistor.

* * * * *